US008546057B2

(12) United States Patent
Tyagi et al.

(10) Patent No.: US 8,546,057 B2
(45) Date of Patent: Oct. 1, 2013

(54) CARBON BASED BLACK TONERS PREPARED VIA LIMITED COALESCENCE PROCESS

(75) Inventors: Dinesh Tyagi, Fairport, NY (US); Louise Granica, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 271 days.

(21) Appl. No.: 13/017,384

(22) Filed: Jan. 31, 2011

(65) Prior Publication Data

US 2012/0196221 A1 Aug. 2, 2012

(51) Int. Cl.
*G03G 9/08* (2006.01)

(52) U.S. Cl.
USPC ..... 430/137.1; 430/137.14

(58) Field of Classification Search
USPC ..... 430/137.1, 137.14
See application file for complete search history.

(56) References Cited

U.S. PATENT DOCUMENTS

| | | | | |
|---|---|---|---|---|
| 4,089,472 | A | 5/1978 | Siegel et al. | |
| 4,833,060 | A | 5/1989 | Nair et al. | |
| 4,835,084 | A | 5/1989 | Nair et al. | |
| 4,965,131 | A | 10/1990 | Nair et al. | |
| 5,118,588 | A | 6/1992 | Nair et al. | |
| 5,133,992 | A | 7/1992 | Nair et al. | |
| 6,316,157 | B1 * | 11/2001 | Yoshikawa et al. | 430/108.3 |
| 2001/0055722 | A1 | 12/2001 | Rimai et al. | |
| 2007/0071511 | A1 * | 3/2007 | Suzuki et al. | 399/307 |
| 2008/0241727 | A1 * | 10/2008 | Norikane et al. | 430/110.4 |
| 2008/0248416 | A1 * | 10/2008 | Norikane et al. | 430/137.18 |
| 2010/0316944 | A1 * | 12/2010 | Nakajima et al. | 430/105 |
| 2011/0064489 | A1 * | 3/2011 | Bisaiji et al. | 399/324 |

FOREIGN PATENT DOCUMENTS

JP 2004144804 A * 5/2004

OTHER PUBLICATIONS

English language machine translation of JP 2004-144804 (May 2004).*

* cited by examiner

*Primary Examiner* — Christopher Rodee
(74) *Attorney, Agent, or Firm* — Andrew J. Anderson; Raymond L. Owens

(57) ABSTRACT

A black toner composition comprising toner particles prepared by a chemical process of manufacture comprising carbon black pigment, a first addition polymer comprising carboxylic acid groups along the polymer backbone, and a thermoplastic second polymer binder distinct from the first polymer, wherein the first polymer has an Acid Value of from 30 to 220 and is present at a weight ratio of greater than 1:2 relative to the amount of carbon, and at a relatively lower weight percent than the second polymer. A process for preparation of such toner particles comprising: preparing a masterbatch comprising a carbon black and a first addition polymer comprising carboxylic acid groups along the polymer backbone and having an Acid Value of from 30 to 220, where the first polymer is present at a weight ratio of greater than 1:2 relative to the amount of carbon; dissolving a thermoplastic second polymer binder in an organic solvent; adding the masterbatch to the solution of second polymer binder to form an organic phase, wherein the first polymer is present at a lower weight percent than the second polymer; dispersing the organic phase in an aqueous phase comprising a particulate stabilizer to form a dispersion; and removing the solvent from the organic phase to form toner particles comprising the first polymer, the second polymer binder and carbon black.

10 Claims, No Drawings

CARBON BASED BLACK TONERS PREPARED VIA LIMITED COALESCENCE PROCESS

FIELD OF THE INVENTION

This invention relates in general to toner and developer useful for electrographic printing and more particularly to carbon based black toners which are prepared via the limited coalescence process.

BACKGROUND OF THE INVENTION

A dry electrographic image such as an electrophotographic image is typically produced by initially forming an electrostatic latent image on a primary imaging member. This image can be formed, for example, by first charging a photoconductive element included in a primary imaging member, then discharging selected portions of that element using optical exposure or an electronic means of exposure such as a laser scanner or an LED array. The resulting electrostatic latent image on the photoconductive element is developed by bringing it into close proximity to an appropriate developer comprising marking or toner particles, which are deposited onto the latent image to convert it into a visible image. The resulting visible image is then transferred to a receiver sheet such as paper using a variety of techniques such as applied heat or pressure, but most commonly by the application of a suitable electrostatic field to urge the toner towards the receiver. After transfer, the image is permanently fixed on the receiver, typically using heat or pressure or a combination thereof to soften the toner comprising the visible image, causing it to be fused and thereby permanently affixed to the receiver. The primary imaging member from which the image has been transferred is then cleaned and made ready for subsequent imaging.

Color images are generally produced by first producing electrostatic latent images corresponding to the primary color separations of the image. For example, to produce a full-color image, cyan, magenta, yellow, and black separations are produced, preferably on separate frames of the primary imaging member. A single frame can be used for all the separations, in which case it is desirable to transfer each separation image after development to a receiver. It is possible, though less desirable, to develop all the images sequentially on the same frame of the primary imaging member and then transfer the entire image to the receiver in one pass. The individual visible separation images are then transferred in register to the receiver.

It is often desirable to first transfer a toned image from the primary imaging member to an intermediate transfer member by the application of a suitable electric field. Images corresponding to the toned separations can be transferred, in register, to the intermediate transfer member and subsequently transferred to the receiver by application of a second electric field to urge the toned image from the intermediate transfer member to the receiver. Alternatively, the separation images can be transferred to the intermediate transfer member and then to the receiver, with the final registration occurring on the receiver. It should be noted that, where reference to four colors is made in this discussion, more or fewer colors can be straightforwardly employed. The intermediate transfer member can comprise either a drum or a web and is preferably a compliant member, as is known in the art.

Color printed images produced on xerographic devices have found many usage in both and commercial and consumer applications. One application that is increasingly becoming more important is the photo printing market. In order to duplicate the image quality that can be achieved with silver halide process, however, the image quality of the toner based electrophotographic process needs to be further improved. For this reason, toner manufactures are continuously trying to decrease the size of the marking particle. Previously, color electrophotographic printers used toner particles which were in the 10-12 microns range. More recently, the color toner particle size typically used is in the 6 to 8 microns range in an attempt to meet the increasing higher image quality needs. There are many factors that make it extremely difficult to use even smaller toner particles in printers. One of the main reasons for such difficulties is the inability of the existing conventional Melt Pulverized Toner (MPT) manufacturing processes to make a smaller toner in an economical manner.

In the conventional Melt Pulverized Toner (MPT) process, the desired polymeric binder for toner application is produced independently. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The melt product is cooled and then typically initially ground to a volume average particle size of from about 18 to 50 micrometers. It is generally preferred to first grind the melt product prior to a specific pulverizing operation. The grinding can be carried out by any convenient procedure. For example, the solid toner can be crushed and then ground using, for example, a fluid energy or jet mill, such as described in U.S. Pat. No. 4,089,472, and can then be classified in one or more steps. The size of the particles is then further reduced by use of a high shear pulverizing device such as a fluid energy mill to yield toner particles as small as about 6 microns. But as further reduction in toner particles are made, the energy requirements as well as the grinding times increase rapidly in a relationship which is proportional to the amount of surface area which is created. Further, as smaller toners are produced, the amount of toner fines generated during the pulverized also increased. These fines have to be removed from the distribution using typical classification processes prior to the toner being used. As a result, the yields become increasingly lower as smaller toners particles are produced. This all leads to increase in the toner cost. Therefore, typical MPT processes are not practical for making small toner particles.

There are additional reasons for producing smaller toner size marking particles. As the size of the toner is decreased, the amount of toner used for printing also is reduced. This leads to improved cost performance as well as reduced image relief. Further, the fusing becomes easier as the toner stack is reduced.

As an alternate approach to making toners particles, Chemically Prepared Toners (CPT) is becoming increasingly more popular. One of the main advantages with chemically prepared toner is their ability to produce smaller particle size toners with narrow size distribution. In general, the method of chemically produced toners involves growing small particles till the desired particle size has been achieved. Although the term CPT is used to describe all non-melt pulverizing methods of producing toners, the various methods used to make such toners are very different. Among the several methods for making chemically prepared toner are the polymer suspension, suspension polymerization, and Emulsion Aggregation (EA) processes, which are very well known in the art.

The developer employed in electrophotographic printing comprises marking or toner particles and preferably further comprises magnetic carrier particles in a so-called two-component developer, which is generally used in a magnetic brush, known in the art. In addition, the developer can include a third component comprising particulate addenda of submicron size, for example, silica, strontium titanate, barium titanate, titanium dioxide, various polymeric particles. These addenda are typically employed to control flow, enhance transfer, and control toner charge-to-mass characteristics. The developer may also comprise other materials such as charge agents.

It is important in electrophotographic development that the toner be electrically insulating. If it is not, the absolute value of the toner charge-to-mass, referred to hereafter simply as "toner charge-to-mass," can become so low that mechanical agitation at the development station causes the toner to separate from the developer as a dust cloud, whose deposition on the primary imaging member results in unacceptable background in the final print. In addition, the airborne toner can be deposited on other surfaces such as those of the charging device, causing contamination that adversely affects the operation of the device, resulting in lost productivity and possibly requiring an expensive service call. Such problems are particularly troublesome at magnetic core development stations, especially those in which the core rotates, referred to as the SPD process, as described in Miskinis, IS&T Sixth International Congress on Advances in Non-Impact Printing, pp. 101-110. In such stations the magnetic core imparts significant agitation to the developer, thereby inducing significant dusting if the toner has too low a charge-to-mass.

The electrostatic transfer field for transferring the toned image to either the intermediate transfer member or the receiver can be accomplished in a number of ways known in the art, most frequently through the use of either a biased roller or a corona charger. A compliant intermediate transfer member can comprise the biased roller.

Although many receivers are known in the art, including transparency stock, cloth, and metal, paper is most commonly employed as the receiver. It is generally desirable that the transfer member, intermediate transfer member, and receiver have finite resistivities in order to establish the electrostatic transfer field. Furthermore, to ensure successful toner transfer, it is necessary that the toner particles bear an electric charge that is maintained throughout the transfer process. The electrostatic force urging the toner to transfer is the mathematical product of the charge on the toner and the applied electrostatic transfer field. If the toner loses its charge, or worse, if the sign of the charge changes during the transfer process, the toner would fail to transfer.

To prevent toner from discharging, the toner must be electrically insulating, with no electrically conducting components residing at the toner particle surface, where they could contact a second electrically conductive material such as paper, fabrics, metals, etc., during the transfer process. Were this to occur, charge could travel from a conducting component at the toner surface to the second conductive material under the influence of the electric field, causing the toner to reach an equipotential state with the second material, for example, a paper receiver. Under normal relative humidity conditions, paper is fairly electrically conductive. Charge would bleed from the toner to the paper, ultimately reaching the potential of the paper. Under this circumstance, the toner would be more attracted to the transfer member than the paper receiver, thereby preventing toner transfer. The toner could also lose charge in the development station by contacting carrier, other toner particles, or metallic components of the station.

Although the polymer binder included in the toner is insulating, electrically conducting agents, for example, electrically conducting pigments such as carbon are frequently incorporated into toner particles. Carbon is a preferred pigment for black toner because it is inexpensive and non-fading, but it is also electrically conductive. This conductivity of carbon generally does not present a problem if it is dispersed into a molten polymer binder to form a solid block of pigment-binder material, from which toner particles are produced by grinding and classifying. However grinding and classification techniques are disadvantageous for the production of toner particles of uniform size distribution and small diameter, i.e., mean volume weighted diameter less than 8 μm, as measured by devices such as a Coulter Multisizer, available from Coulter Electronics, Inc. For the production of such toner particles, colloidally stabilized limited coalescence (LC) suspension processes that entail dissolving either the polymer comprising the toner binder ("polymer suspension") or the monomers that combine to form the polymer binder ("suspension polymerization") in an organic solvent, and dispersing appropriate additional toner components such as the pigment particles in the solution, are useful. Colloidally stabilized suspension processes useful in the practice of the present invention are described in, for example, U.S. Pat. Nos. 4,833,060; 4,835,084; 4,965,131; and 5,133,992; the disclosures of which are incorporated herein by reference.

In colloidally stabilized suspension processes, which are carried out in a mixture of water and a hydrophobic organic phase, fine hydrophobic particles such as silica, titania, various latices, etc., prevent the formation and separation of macroscopic hydrophilic and hydrophobic phases. If desired, the particles that limit coalescence can be removed by such processes as dissolution in strong alkalis, etc. Throughout this disclosure, toners formed by dispersing pigments and hydrophobic solutions of polymers or monomers in water will be referred to as LC toners. Although LC toners formed in this manner generally charge well, black LC toners, defined as LC toners that include carbon as the pigment, do not. Specifically, black LC toners tend to display an undesirably low charge-to-mass. Consequently, the force applied to the toner to urge it from the transfer member may be insufficient to overcome those forces holding the toner to the member. Moreover, although it might be expected that transfer would improve with increasing transfer voltage until air breakdown occurs, transfer that appears satisfactory at low voltages may unexpectedly achieve an undesirably low maximum prior to decreasing with increasing transfer voltage. Also, black carbon may flocculate in LC processes, leading to less than desired covering power.

In U.S. Pat. No. 5,118,588, the disclosure of which is incorporated by reference herein, there is described a process of making chemically prepared toners by which a pigment surface can be rendered hydrophobic by reacting the hydrophilic pigment particles with a relatively low weight percent of additives that contain some functional groups. Although high transfer efficiency is demonstrated for the resulting toner, the pigment dispersion in the individual toner particles may not be uniform as evident from the TEM cross-sections, which may result in lower than desired printing densities and covering power for the toner. Publication No. US2001/0055722, the disclosure of which is incorporated by reference herein, discloses use of LC toners comprising carbon black pigment of specified BET value and use of submicron particulate surface treatment to provide high transfer efficiencies. Although transfer efficiencies may be improved, pigment dispersions in individual toner particles again may not be as uniform as desired. When smaller toners particles are desired which are capable of delivering high optical density, these approaches may not be sufficient. Further, if more carbon is added to increase the optical density, the approach leads back to the issue of lowering the charge/mass and reduced transfer efficiency.

Thus there is a continuing need for black toner compositions, and in particular relatively small sized black toner compositions, that provide high charge/mass and high transfer efficiency, especially from the intermediate transfer member of an electrophotographic apparatus to a paper receiver, as well as providing good optical densities and covering power. This need is met by the toner composition and process of the present invention.

SUMMARY OF THE INVENTION

In one aspect, the invention is directed towards a process for preparation of toner particles comprising carbon black and polymeric binder, comprising:

preparing a masterbatch comprising a carbon black and a first addition polymer comprising carboxylic acid groups along the polymer backbone and having an Acid Value of from 30 to 220, where the first addition polymer is present at a weight ratio of greater than 1:2 relative to the amount of carbon;

dissolving a thermoplastic second polymer binder in an organic solvent;

adding the masterbatch to the solution of second polymer binder to form an organic phase, wherein the first addition polymer is present at a lower weight percent than the second polymer;

dispersing the organic phase in an aqueous phase comprising a particulate stabilizer to form a dispersion; and removing the solvent from the organic phase to form toner particles comprising the first addition polymer, the second polymer binder and carbon black.

In a second aspect, the invention is directed towards a black toner composition comprising toner particles prepared by a chemical process of manufacture comprising carbon black pigment, a first addition polymer comprising carboxylic acid groups along the polymer backbone, and a thermoplastic second polymer binder distinct from the first polymer, wherein the first addition polymer has an Acid Value of from 30 to 220 and is present at a weight ratio of greater than 1:2 relative to the amount of carbon, and at a relatively lower weight percent than the second polymer.

A feature of the present invention is to provide a black electrophotographic toner, which is capable of providing sufficient image density and charge/mass when such toners are prepared by the chemical processes of manufacturing toners.

A feature of the present invention is to provide a black electrophotographic toner, which is capable of providing sufficient image density and charge/mass when such toners are prepared by the limited coalescence processes of manufacturing toners.

A feature of the present invention is to provide a black electrophotographic toner, which is capable of providing improved transfer efficiency and which is capable of being used in an electrophotographic process which involves four or more color modules.

Additional features and advantages of the present invention will be set forth in part in the description which follows, and in part will be apparent from the description, or may be learned by practice of the present invention.

This invention is directed to toner and developer useful for electrographic printing, and more particularly to a black toner composition that can be used in an electrophotographic printer. Such electrographic printing may include the steps of forming a desired print image, electrographically, on a receiver member utilizing standard CYM color marking particles; and in the area of the formed print image, where black is desired, selectively forming such black layer, utilizing the toner of this invention whose composition is different from that of the standard CYM marking particles of the desired print image. In the preferred embodiment, the toner of this invention is black and predominantly contains carbon black as the pigment.

It was determined that it is possible to prepare a carbon based black toner by chemically prepared method of toner manufacturing which is capable of providing both desired color density as well as acceptable charge/mass. Such a toner could be applied to the image by itself or along with other standard CYM colors to provide intended colors.

DETAILED DESCRIPTION OF THE INVENTION

Relatively high densities, covering power and transfer efficiencies, particularly from an intermediate transfer member of an electrophotographic apparatus to a paper receiver, are obtained with black toner compositions of the present invention, which include pigmented LC toner particles comprising carbon black pigment, a first addition polymer comprising carboxylic acid groups along the polymer backbone, and a thermoplastic second polymer binder distinct from the first addition polymer, wherein the first addition polymer has an Acid Value of from 30 to 220, more preferably 50 to 200 and most preferably 50 to 150, and is present at a weight ratio of greater than 1:2 relative to the amount of carbon, but at a relatively lower weight percent than the second polymer binder. Such toner compositions may be advantageously obtained by limited coalescence manufacturing processes wherein the first addition polymer is employed to form a masterbatch with the carbon black prior to addition of the masterbatch to a solution of the second polymer, or monomers which polymerize to form the second polymer, which is employed as the primary binder polymer in a limited coalescence process.

When used herein, the term "acid value," also known as "acid number," is defined by the number of milligrams of potassium hydroxide required to neutralize one gram of polymer. Thus, the acid value of a given polymer is related to the percent of acid-containing monomer or monomers. The higher the acid value, the more acid functionality is present in the polymer. It is well known that the acid value can be obtained by titrating a solution of the polymer, in the presence of an indicator such as phenolphthalein, with a dilute solution of potassium hydroxide.

In a limited coalescence process for producing an LC toner, a polymer binder or polymer-forming monomer is dissolved in an organic solvent, other ingredients such as, for example, carbon black pigment particles are added, and the resulting slurry is dispersed in water. A particulate stabilizer hydrophilic dispersing agent such as silica, latex, strontium titanate, titania, etc., typically having a diameter in the range of tens of nanometers, is present in the aqueous phase (water), or added to the slurry. The dispersing agent particles tend to flocculate at the organic-aqueous interface, thereby limiting the coalescence of the organic phase. Hydrophilic carbon particles that are present as the LC toner pigment also tend to flocculate at the water-organic solvent interface to reduce the Gibbs free energy of the system. If the carbon at a toner particle surface comes into contact with an electrically conducting material, an exchange of charge is likely, particularly, when, in addition to the charge on the particle, there is an applied electrostatic field that is supposed to urge the toner particles towards the conducting member. The present invention is directed towards reducing the tendency of such carbon coming to the surface of an LC toner particle, while also enabling improved density and covering power for the toner compositions through the use of a first addition polymer of specified Acid Value and weight ratio relative to that of the carbon black in addition to the main toner binder polymer.

In the black toner composition of the present invention, the pigmented LC toner particles preferably have a mean volume-average diameter preferably of less than about 8 μm, more preferably, from about 3 μm to about 7 μm, and include, preferably, about 1 wt. % to about 20 wt. %, more preferably, about 3 wt. % to about 10 wt. %, most preferably, about 5 wt. % to about 8 wt. % of carbon pigment. The first addition polymer of specified Acid Value is employed at a weight ratio of greater than 1:2 relative to the weight of carbon, more preferably at a weight ratio of at least 1:1, and typically up to a weight ratio of 4:1, more preferably up to a weight ratio of 3:1, and most preferably up to a weight ratio of 2:1 relative to the weight of carbon. Use of the first addition polymer at lower weight ratios may result in non-uniform pigment dispersion in the toners, while use of higher weight ratios may adversely impact the desired properties of the toner main polymer binder.

The thermoplastic second polymer included in the pigmented particles as the main polymer binder is preferably selected from the group consisting of polyolefins, styrene resins, acrylic resins, polyesters, polyurethanes, polyamides, polycarbonates, and mixtures thereof. Of these, polyesters are preferred. Among useful polyesters are copolyesters prepared from terephthalic acid (including substituted terephthalic acid), a bis[(hydroxyalkoxy)phenyl]alkane having from 1 to 4 carbon atoms in the alkoxy radical and from 1 to 10 carbon atoms in the alkane moiety (which can also be a halogen-substituted alkane), and an alkylene glycol having from 1 to 4 carbon atoms in the alkylene moiety. The thermoplastic second polymer binder typically comprises greater than 50 weight percent of the toner particles, more preferably from about 70 to 95 weight percent of the toner particles, while the first addition polymer employed to form the masterbatch comprises less than 50 weight percent of the toner particles, more preferably from about 1 to 25 weight percent of the toner particles. The Acid Value of the main polymer binder is typically less than 50, and more typically less than 30, and is preferably lower than the Acid Value of the first addition polymer employed in the present invention.

The first addition polymer employed in the present invention is formed from a mixture of vinyl or unsaturated monomers. In one embodiment, the mixture of monomers includes styrenic monomers. Styrenic monomers which may be employed include, but are not limited to, α-alkylstyrenes, trans-β-alkylstyrenes, alkylstyrenes, alkoxystyrenes, halogenated styrenes, vinyl naphthalenes and mixtures thereof. Specific examples of styrenic monomers include styrene, α-methylstyrene, trans-β-methylstyrene, 3-methylstyrene, 4-methylstyrene, 3-ethyl styrene, 3-isopropyl styrene, 3-butyl styrene, 3-cyclohexyl styrene, 3,4-dimethyl styrene, 3-chlorostyrene, 3,4-dichloro styrene, 3,4,5-trichloro styrene, 3-bromo styrene, 3-iodo styrene, 3-fluoro styrene, 3-chloro-4-methyl styrene, benzyl styrene, vinyl naphthalene, divinylbenzene, methyl vinylbenzoate ester, vinylbenzoic acid, vinyl phenol, 3-methoxy styrene, 3,4-dimethoxy styrene, 3-methyl-4-methoxy styrene, acetoxystyrene, acetoxymethylstyrene and (t-butoxycarbonyloxy) styrene. The styrenic monomers may be substituted with ionic functionalities such as sulfonate and carboxylate. Specific examples include sodium styrenesulfonate and sodium vinylbenzoate.

In another embodiment, the mixture of monomers includes acrylic monomers. The term "acrylic monomer" as employed herein includes acrylic acid, acrylate esters and derivatives and mixtures thereof. Examples of acrylic acid monomers include but are not limited to alkylacrylic acids, 3-alkylacrylic acids and 3-haloacrylic acids. Specific examples include crotonic acid, cinnamic acid, citraconic acid, sorbic acid, fumaric acid, methacrylic acid, ethacrylic acid, 3-methylacrylic acid, 3-chloroacrylic acid and 3-chloromethacrylic acid.

Examples of acrylate esters include but are not limited to alkyl acrylates, aryl acrylates, alkyloxyalkyl acrylates, alkyloxyaryl acrylates, hydroxyalkyl acrylates, hydroxyaryl acrylates, crotonic esters, cinnamic esters, citraconic esters, sorbic esters and fumaric esters. Specific examples include n-butyl acrylate, methyl acrylate, ethyl acrylate, n-propyl acrylate, isopropyl acrylate, amyl acrylate, hexyl acrylate, n-octyl acrylate, lauryl acrylate, 2-chloroethyl acrylate, phenyl acrylate, benzyl acrylate, allyl acrylate, methyl 3-chloroacrylate, 2-ethylhexyl acrylate, 2-methoxyethyl acrylate, 2-(2-methoxyethoxy)ethyl acrylate, 2-ethoxyethyl acrylate, 2-(2-ethoxyethoxyl)ethyl acrylate, 2-hydroxyethyl acrylate, 2-hydroxypropyl acrylate, glycidyl acrylate, N,N-dimethylaminoethyl acrylate, trifluoroethyl acrylate, 2-sulfoethyl acrylate and the corresponding methacrylates.

Acrylic monomers useful in the present invention also include unsaturated anhydride and unsaturated imide monomers which may be completely or partially hydrolyzed after polymerization to form the corresponding carboxylic acid or amide functionality. Specific examples include but are not limited to maleic anhydride, methylmaleic anhydride, glutaconic anhydride, itaconic anhydride, citraconic anhydride, mesaconic anhydride, maleimide and N-methylmaleimide. Also useful are mono-ester and bis-ester derivatives of the aforementioned.

Other monomers useful in forming the first addition polymer employed in the present invention include acrylamide and derivatives such as but not limited to N-alkyl acrylamides, N-aryl acrylamides and N-alkoxyalkyl acrylamides. Specific examples include N-methyl acrylamide, N-ethyl acrylamide, N-butyl acrylamide, N,N-dimethyl acrylamide, N,N-dipropyl acrylamide, N-(1,1,2-trimethylpropyl)acrylamide, N-(1,1,3,3-tetramethylbutyl)acrylamide, N-methoxymethyl acrylamide, N-methoxyethyl acrylamide, N-methoxypropyl acrylamide, N-butoxymethyl acrylamide, N-isopropyl acrylamide, N-s-butyl acrylamide, N-t-butyl acrylamide, N-cyclohexyl acrylamide, N-(1,1-dimethyl-3-oxobutyl)acrylamide, N-(2-carboxyethyl)acrylamide, 3-acrylamido-3-methyl butanoic acid, methylene bisacrylamide, N-(3-aminopropyl)acrylamide hydrochloride, N-(3,3-dimethylaminopropyl)acrylamide hydrochloride, N-(1-phthalamidomethyl)acrylamide, sodium N-(1,1-dimethyl-2-sulfoethyl)acrylamide and the corresponding methacrylamides.

Besides being derived from styrenic and acrylic monomers, the first addition polymers useful in the present invention may have functionality derived from a variety of other types of monomers well known in the art of polymer chemistry. Such monomers include vinyl derivatives and ethylenically unsaturated compounds in general. Examples of these other monomer types include but are not limited to olefins (e.g., dicyclopentadiene, ethylene, propylene, 1-butene, 5,5-dimethyl-1-octene, etc.); halogenated olefins (e.g., vinyl chloride, vinylidene chloride, etc.); α-alkylalkenes, acrylonitriles, acroleins, vinyl ethers, vinyl esters, vinyl ketones, vinylidene chloride compounds, allyl compounds, and ethylenically unsaturated heterocyclic compounds. Specific examples include allyl acetate, allyl caproate, methyl vinyl ether, butyl vinyl ether, methoxyethyl vinyl ether, ethoxyethyl vinyl ether, chloroethyl vinyl ether, 1-methyl-2,2-dimethylpropyl vinyl ether, hydroxyethyl vinyl ether, diethylene glycolvinyl ether, dimethylaminoethyl vinyl ether, butylaminoethyl vinyl ether, benzyl vinyl ether, tetrahydrofurfuryl vinyl ether, vinyl acetate, vinyl propionate, vinyl butyrate, vinyl isobutyrate, vinyl dimethyl propionate, vinyl ethyl butyrate, vinyl chloroacetate, vinyl dichloroacetate, vinyl methoxyacetate, vinyl phenyl acetate, vinyl acetoacetate, N-vinyl oxazolidone, N-vinylimidazole, N-vinylpyrrolidone, N-vinylcarbazole, vinyl thiophene and N-vinylethyl acetamide.

Cross-linkable functional groups well known in the art of polymer chemistry may also be imparted to any one of the monomers described above, either before or after polymerization. The first addition polymer employed in the invention is then generated by reaction of the cross-linkable functional groups under conditions well known in the art of polymer chemistry. The first addition polymer employed in the invention may be derived from multi random copolymer, a block copolymer, a graft copolymer, or an alternating copolymer.

Preferably, the first addition polymer is a styrene-acrylic copolymer comprising a mixture of vinyl or unsaturated monomers, including at least one styrenic monomer and at least one acrylic monomer, at least one of which monomers has an acid or acid-providing group. Any addition polymer can be used in the present invention provided it has an acid value of from 30 to 220, more preferably 50 to 200 and most preferably 50 to 150. Preferred polymers include, for example, styrene-acrylic acid, styrene-acrylic acid-alkyl acrylate, styrene-maleic acid, styrene-maleic acid-alkyl acrylate, styrene-methacrylic acid, styrene-methacrylic acid-alkyl acrylate, and styrene-maleic acid half ester, wherein each type of monomer may correspond to one or more particular monomers. Examples of addition polymers include but are not limited to styrene-acrylic acid copolymer, (3-methyl styrene)-acrylic acid copolymer, styrene-methacrylic acid copolymer, styrene-butyl acrylate-acrylic acid terpolymer, styrene-butyl methacrylate-acrylic acid terpolymer, styrene-methyl methacrylate-acrylic acid terpolymer, styrene-butyl acrylate-ethyl acrylate-acrylic acid tetrapolymer and styrene-(α-methylstyrene)-butyl acrylate-acrylic acid tetrapolymer.

In one embodiment, the styrene-acrylic polymer comprises at least one acrylic monomer that is functionalized with a carboxylic acid group. The relative amounts of monomers used is not particularly limited, as long as the styrene-acrylic polymer has an acid value as specified.

The first polymer is preferably selected to have a relatively low weight average molecular weight relative to that of the main binder polymer, e.g., preferably 3,000 to 20,000, more preferably 3,000 to 15,000, and most preferably 4,000 to 10,000, and preferably has a lower viscosity than that of the main binder polymer. The first polymer may be selected from, e.g., commercially available vinyl polymers having carboxylic acid groups along the polymer backbone in an amount sufficient to provide the stated Acid Value. Practical examples of styrene-acrylic copolymers for use in the present invention include JONCRYL 586, JONCRYL 611, and JONCRYL 680 (available from BASF Corporation), although the first addition polymers being used in this invention are not limited to them. These addition polymers can be used as a combination thereof.

The first addition polymer having an Acid Value of from 30 to 220, more preferably 50 to 200 and most preferably 50 to 150, is employed in the present invention to form a masterbatch with carbon particles, which masterbatch is combined with a second polymer binder to form toner particles. Polymers of lower or higher Acid Value result in lower absolute value charge/mass values for the resulting toner particles.

Further additives as are well known in the toner art, such as charging agents and wax-based release agents, may further be employed in the toner compositions of the present invention. In addition to the carbon black employed as pigment in the toner compositions, additional colorants, including dyes or colored pigments, may be employed in combination with such carbon black where desired to adjust the hue of the toner.

Although not necessarily required, the toner composition of the present invention may further comprise from about 0.1 wt. % to about 10 wt. %, more preferably, about 0.5 wt. % to about 5 wt. %, most preferably, about 1 wt. % to about 2.5 wt. %, of particulate addendum material on the surface of the LC toner particles to further enhance transport efficiencies. Such particulate addendum material typically has a volume-average diameter of, preferably, about 10 nm and about 0.3 μm, more preferably, about 20 nm to about 100 nm. Suitable particulate addendum materials include silica, titania, barium titanate, strontium titanate, colloidal polymer latices, and mixtures thereof. Of these, silica is preferred.

In an electrophotographic apparatus, the applied electrostatic field associated with transfer can be applied by one of several means. The preferred means is to contact the receiver sheet with a semiconducting roller. The resistivity of the roller is typically between $10^7$ and $10^{12}$ Ω·cm, preferably between $10^8$ and $10^{10}$ Ω·cm. This roller generally comprises an elastomeric member such as polyurethane on a conducting core such as aluminum. A bias of between 1,000 and 3,000 volts, preferably between 1,000 and 2,000 volts, is applied to the core. Alternatively, a roller comprising an elastomeric layer with a lower resistivity can be used. In this case, the resistivity would be between $10^5$ and $10^7$ Ω·cm, and the voltages applied to the conducting core would be correspondingly lower, typically between 500 and 1,000 volts. Alternatively, charge can be sprayed directly onto the back of the receiver by a suitable device such as a corona charger.

Although the electrostatic latent image can be formed by any of a number of electrographic techniques, it is preferred that the image be formed electrophotographically, using a primary imaging member that comprises a photoconductor. The photoconductor is initially charged to the desired potential using suitable, known charging devices such as a corona or roller charger, and the electrostatic latent image is formed by exposing portions of the charged photoconductor to light. Exposure can be accomplished using either optical or electronic means such as a laser scanner or LED array.

The electrostatic latent image is made into a visible image by bringing the electrostatic latent image into proximity with a developer comprising black toner particles of the present invention. The developer can be an insulating single-component developer or, preferably, a two-component developer comprising the toner particles and magnetic carrier, preferably ferrite, particles. Although any suitable means for applying toner to the electrostatic latent image can be used, it is preferred to use a magnetic development brush, and more preferably, a small particle development (SPD) development brush.

The developed image produced with a black toner of the present invention can be transferred directly from the primary imaging member to the receiver or, preferably, to an intermediate transfer member, preferably a compliant intermediate transfer member upon application of a suitable electrostatic field, as is known in the art. Application of the electrostatic field can be accomplished by applying a suitable potential sufficiently large in magnitude to overcome the attraction of the field attracting the toner to the receiver. Alternatively, the potential on the intermediate can be decreased, or preferably, the conductive layer of the intermediate can be grounded and a suitable urging potential applied to the receiver using known means such as a biased roller or plate, a corona charger, etc. As a further alternative, the sign of the potential to the intermediate transfer member can be reversed and the receiver grounded prior to transfer of the developed image intermediate transfer member to the receiver. The image on the receiver may then be fused by conventional means (e.g., heated rollers), and the primary and intermediate transfer members are cleaned and made ready for subsequent image formation.

EXAMPLES

KAO BINDER E, a polyester resin, used in the examples below was obtained from Kao Specialties Americas LLC, a subsidiary of Kao Corporation, Japan. The Carbon black used as pigment in these examples is manufactured by Cabot Corporation. Various carbon black masterbatches were prepared using 40% by weight of either Cabot BLACK PEARLS 280 or Cabot CARBON MOGUL L carbon, and 60% by weight various vinyl or polyester polymers. All polyesters used for making a masterbatch comprised a linear copolymer of fumaric acid and bisphenol A.

The particle size distribution was characterized by a Coulter Particle Analyzer. The volume median value (equivalent diameter) from the Coulter measurements was used to represent the particle size of the particles described in these examples.

Charge, Dust and Covering Power Measurements

The toner charge per mass (Q/m) ratio was measured using a "MECCA" electrostatic device comprised of two spaced-apart, parallel, electrode plates which can apply both an electrical and magnetic field to the developer samples, thereby causing a separation of the two components of the mixture, i.e., carrier and toner particles, under the combined influence of a magnetic and electric field. A 0.100 g sample of a developer mixture was placed on the bottom metal plate. The sample was then subjected for thirty (30) seconds to a 60 Hz magnetic field and potential of 2000 V across the plates, which causes developer agitation. The toner particles were released from the carrier particles under the combined influence of the magnetic and electric fields and were attracted to and thereby deposited on the upper electrode plate, while the magnetic carrier particles were held on the lower plate. An electrometer measured the accumulated charge of the toner on the upper plate. The toner Q/m ratio in terms of microcoulombs per gram (μC/g) was calculated by dividing the accumulated charge by the mass of the deposited toner taken from the upper plate. TC was calculated by dividing the toner weight by the initial developer sample weight. By reversing the polarity of the applied potential, the amount and Q/m of wrong-sign toner could also be determined.

"Pre-conditioned" carrier is obtained by bottle brushing for 60 minutes a carrier sample mixed with 16% toner to be tested, and stripping off the toner on a development roller. This carrier is then mixed with fresh toner, and Q/m measured (referred to as strip and rebuilt Q/m) to determine whether the charging behavior of the carrier had changed during use. The stripped carrier is rebuilt with fresh toner at 8 percent toner concentration. The developer is wrist shaken for 2 minutes and "Fresh" charge is measured using the MECCA device. This developer is then placed on a magnetic roller where it is exercised for 10 minutes with magnetic core rotating at 2000 rpm. The "Aged" charged is measured again using MECCA.

In a printer, replenishment toner is added to the developer station to replace toner removed in the process of printing copies. This toner is uncharged and gains a triboelectric charge by mixing with the developer. During this mixing process uncharged or low charged particles can become airborne and result in background on prints or dust contamination within the printer.

A "dusting test" is performed during experimentation to evaluate the potential for a replenishment toner to form background or dust. The 4 g developer sample at 8% toner concentration (3.68 g carrier+0.32 g toner) is exercised on a rotating shell and magnetic core developer station. After 10 minutes of exercising, 0.16 g of fresh uncharged replenishment toner was added to the developer. A fine filter over the developer station then captures airborne dust that is generated when the replenishment toner is added, and the dust collected is weighed as milligrams of dust. The lower the value for this "dust" measurement corresponds to a better toner performance. Typically, low values of dust (less than 50 milligrams as measured in this test) in addition to more negative toner charge (−40 to −81 μC/g) are desirable.

The covering power was measured by developing uniform density patches of toner on a transparent substrate. The substrate was then fused by passing it through a pair of hot non-compliant rollers at a temperature of 125 C at 10 mm/second. The transmission density was then calculated for various images developed. Using the sample that yielded a transmission density of 1, the covering power was calculated as the cm2 of area that can be covered uniformly by 1 gram of toner to provide a uniform laydown with a $D_{transmission}=1$.

Preparation of Wax Dispersions

To a glass jar containing a mixture of wax and dispersant in ethyl acetate were added zirconia beads (0.8 mm). Wax was used at 10% by weight, and TUFTEC P-2000 dispersant at 1% by weight of the total mixture. TUFTEC P-2000, commonly termed a compatibilizer, was a polymer of Styrene/(butadiene/butylene) (67/33 wt %) and was purchased from Asahi Kasei Chemicals Corporation (Tokyo, Japan). The container was then placed on a Sweco Powder Grinder and the wax milled for one to three days. Afterwards, the beads were removed by filtration through a screen and the resulting solid particle dispersion was used for toner preparation as follows.

Comparative Examples C1A-C1C

An organic phase dispersion was prepared using 82.51 g of ethyl acetate, 20.83 g of KAO BINDER E, 13.16 g of Carbon Masterbatch which comprised a low molecular weight styrene-butylacrylate-methacrylic acid copolymer (weight average molecular weight approx. 20,000) and Cabot BLACK PEARLS 280. The Acid Value (AV) of this polymer used in the preparation was 10 as indicated in Table 1. The mixture was stirred overnight with a magnetic stirrer. This organic phase is mixed with an aqueous mixture prepared with 176.06 g of water, 1.15 g of potassium hydrogen phthalate (KHP), 8.44 g of NALCO 1060 and 1.86 g of 10% promoter (poly (adipic acid-comethylaminoethanol)). This mixture was then subjected to very high shear using a Silverson L4R Mixer (sold by Silverson Machines, Inc.) followed by a Microfluidizer sold by Microfluidics. Upon exiting the microfluidizer, the ethyl acetate solvent was removed with a rotary evaporator under reduced pressure. The solid particles were treated with 400 g of a 0.1 N KOH solution at room temperature for 2 hours and then collected by filtration, washed, and dried. The toner particles have a volume median size of 6 microns.

The amount of carbon masterbatch for Comparative Example C1A was such that the resulting toner would have a carbon concentration of 6% by weight. Two more samples were prepared so that the carbon concentration was 8% and 10% by weight (C1B and C1C).

Comparative Examples C2A-C2D

Four toners were prepared the same way as in Comparative Example C1A, except that the vinyl polymers used for preparing the masterbatches had an Acid Value ranging from 0 to 10 as indicated in Table 1, and Cabot CARBON MOGUL L was used as the carbon black. The collected toner particles for each toner had volume median sizes of about 6.5 microns.

Comparative Example C3A-C3D

Four toners were prepared the same way as in Comparative Examples C2A-C2D except that a polyester binder was used for preparing the masterbatches. The polyester polymers had weight average molecular weights of from about 14,000 to 26,000, and the acid value of the polyester polymers ranged from 18 to 28 as indicated in Table 1. The collected toner particles for each toner had volume median sizes of about 6 microns.

Comparative Example C4

A black toner was prepared the same way as in Comparative Examples C2A-C2D except in place of a masterbatch, the carbon particles were first milled in the same manner as the wax as described above. A polyester with a weight average molecular weight of about 14,000 and an AV of 22, was then added to the ethyl acetate dispersion of the carbon and stirred overnight. This room temperature treated mixture of carbon was mixed with other toner ingredients to prepare the toner by the LC process as described above. The collected toner particles had a volume median size of about 5.8 microns.

Comparative Example C5

A black toner was prepared the same way as in Comparative Examples C2A-C2D except in place of a masterbatch, the carbon particles were first milled in the same manner as the wax as described above. A polyester with a weight average molecular weight of about 18,000 and an AV of 45, was then added to the ethyl acetate dispersion of the carbon and stirred overnight. This room temperature treated mixture of carbon was mixed with other toner ingredients to prepare the toner by the LC process as described above. The stability of the dispersion obtained upon mixing the organic phase and aqueous composition was affected, resulting in formation of a coagulum for the majority of the toner materials. The LC process is thus designated as failing.

Inventive Example 1A thru 1F

An organic phase dispersion was prepared using 86.35 g of ethyl acetate, 21.39 g of KAO BINDER E, 8.78 g of Carbon Masterbatch which comprised JONCRYL 611 (acrylate-acrylic copolymer having weight average molecular weight of about 8100) and Cabot CARBON MOGUL L. The AV of this polymer used in the preparation was 50 as indicated in Table 1. The mixture was stirred overnight with a magnetic stirrer. This organic phase is mixed with an aqueous mixture prepared with 176.06 g of water, 1.15 g of potassium hydrogen phthalate (KHP), 8.44 g of NALCO 1060 and 1.86 g of 10% promoter (poly(adipic acid-comethylaminoethanol)). This mixture was then subjected to very high shear using a Silverson L4R Mixer (sold by Silverson Machines, Inc.) followed by a Microfluidizer sold by Microfluidics. Upon exiting the microfluidizer, the ethyl acetate solvent was removed with a rotary evaporator under reduced pressure. The solid particles were treated with 400 g of a 0.1 N KOH solution at room temperature for 2 hours and then collected by filtration, washed, and dried. The toner particles have a volume median size of about 6 microns.

The amount of carbon masterbatch for Invention Example 1A was such that the resulting toner would have a carbon concentration of 4% by weight. Five more samples were prepared so that the carbon concentration was 6%, 8%, 10%, 12% and 14% by weight (Examples 1B-1F).

Inventive Example 2A thru 2C

Three toners were prepared the same way as in Inventive Examples 1A-1F except that JONCRYL 586 (acrylate-acrylic copolymer having weight average molecular weight of about 4600) was used for preparing the masterbatches. The AV of this acrylate-acrylic copolymer was 106 as indicated in Table 1. The collected toner particles had a volume median size of about 6.3 microns. The carbon loading for these toners was 4%, 6% and 8% by weight of the dry toner product (Examples 2A-2C).

Inventive Examples 3A thru 3D

Four toners were prepared the same way as in Inventive Examples 1A-1F except that JONCRYL 680 (acrylate-acrylic copolymer having weight average molecular weight of about 4900) was used for preparing the masterbatches. The AV of this acrylate-acrylic copolymer was 200 as indicated in Table 1. The collected toner particles had a volume median size of about 6 microns. The carbon loading for these toners was 3%, 5%, 6%, and 8% by weight of the dry toner product (Examples 3A-3D).

TABLE 1

| Sample | Carbon Conc % | MB Polymer (60% of MB) | AV of Polymer in MB | Fresh Q/m 2 min | Aged Q/m 10 min | Dusting mg | Covering Power $cm^2/g$ |
|---|---|---|---|---|---|---|---|
| C1 | 6 | Vinyl Polymer | 10 | −24 | −39 | 128.1 | 2110 |
| C1 | 8 | Vinyl Polymer | 10 | −12 | −23 | 99.9 | 2335 |
| C1 | 10 | Vinyl Polymer | 10 | −5 | −9 | 132.9 | 2957 |
| C2 | 6 | Vinyl Polymer | 0 | −24 | −17 | 145.3 | 2168 |
| C2 | 6 | Vinyl Polymer | 2 | −22 | −12 | 140.1 | 2245 |
| C2 | 6 | Vinyl Polymer | 5 | −13 | −19 | 153.5 | 2205 |

TABLE 1-continued

| Sample | Carbon Conc % | MB Polymer (60% of MB) | AV of Polymer in MB | Fresh Q/m 2 min | Aged Q/m 10 min | Dusting mg | Covering Power $cm^2/g$ |
|---|---|---|---|---|---|---|---|
| C2 | 6 | Vinyl Polymer | 10 | −15 | −33 | 134.3 | 2195 |
| C3 | 6 | Polyester | 18 | −10 | −13 | 131.2 | 2258 |
| C3 | 6 | Polyester | 20 | −17 | −10 | 85.6 | 2319 |
| C3 | 6 | Polyester | 23 | −11 | −14 | 121.5 | 2234 |
| C3 | 6 | Polyester | 28 | −8 | −11 | 150.3 | 2237 |
| C4 | 6 | None | 22 (Toner Binder) | −10 | −6 | 156 | 1845 |
| C5 | 6 | None | 45 (Toner Binder) | | LC Process Failed | | |
| Ex 1A | 4 | Joncryl 611 | 50 | −53 | −57 | 34.9 | 2220 |
| Ex 1B | 6 | Joncryl 611 | 50 | −49 | −58 | 34.2 | 2557 |
| Ex 1C | 8 | Joncryl 611 | 50 | −28 | −66 | 12 | 3653 |
| Ex 1D | 10 | Joncryl 611 | 50 | −26 | −55 | 39.6 | 4255 |
| Ex 1E | 12 | Joncryl 611 | 50 | −20 | −44 | 16.5 | 5043 |
| Ex 1F | 14 | Joncryl 611 | 50 | −20 | −51 | 32.8 | 5759 |
| Ex 2A | 4 | Joncryl 586 | 106 | −51 | −63 | 33.7 | 2234 |
| Ex 2B | 6 | Joncryl 586 | 106 | −45 | −61 | 36.1 | 2418 |
| Ex 2C | 8 | Joncryl 586 | 106 | −48 | −59 | 36.7 | 3323 |
| Ex 3A | 3 | Joncryl 680 | 200 | −20 | −54 | 49.7 | 1412 |
| Ex 3B | 5 | Joncryl 680 | 200 | −8 | −27 | 59.1 | 1934 |
| Ex 3C | 6 | Joncryl 680 | 200 | −7 | −20 | 68.0 | 2478 |
| Ex 3D | 8 | Joncryl 680 | 200 | −5 | −11 | 72.8 | 2792 |

Charge Control Properties

Charge properties of the toners are tabulated on Table 1. The triboelectric charge of toners is an important factor in order for them to perform well during development and transfer. If the charge is too low, the toner will not develop properly and consequently their transfer efficiency suffers. It is important to have high charge/mass (Q/m) developers that are stable with life. Further, it is desirable to have a toner that exhibits low dusting. As shown in Table 1, when carbon masterbatches are made with either vinyl polymer or a polyester binder, the charge/mass ratio of the resulting toner is low when the Acid Value of the polymer is less than about 30. Also, these toners are high dusting behavior which is not desirable.

In comparison examples C4 and C5, carbon particles were first milled in ethyl acetate and then a 22 or 45 acid value polymer is stirred in to treat the surface. When the carbon treated with the 22 Acid Value polymer was used to make the toners as described in Comparative Example C4, no improvement in charge/mass or covering power is observed. With the use of the higher 45 Acid Value polymer in Comparative Example C5, the stability of the suspension was compromised and the LC process failed.

Higher carbon concentration in the toner increases the likelihood of finding carbon on the toner surface. If the said carbon is not fully treated, the charge/mass would be low because of the conductive nature of the carbon particles. As the carbon concentration is increased, the charge/mass shows a significant drop indicating that the carbon is not properly covered by the polymer in the masterbatch making process. However, when the masterbatch polymer is an addition polymer and has an Acid Value of greater than 30, the charge/mass of the toner is greater and the dusting values are lower. When Acid values get to above 200, the charge/mass appears to be impacted once again because of the excess carboxylic acid groups in the toner formulation, and Acid Values of from 50-150 are thus more preferred for the addition polymer used to form the masterbatch.

Carbon Dispersion and Covering Power

A good masterbatch should be such that it should completely cover and shield the carbon particles. But during the toner making process, it should allow for a uniform dispersion of the carbon so that high covering power numbers are achieved. As shown in Comparative examples, in addition to low charge/mass, the covering power numbers do not show corresponding increase as the carbon concentration is increased. This suggests that the carbon is either too agglomerated inside the toner matrix or the carbon particles are present on the toner surface since these carbon particles were not yet sufficiently treated. However, with the use of masterbatch addition polymer with Acid Value of 50, and 106 very good results are observed for covering power. There is also a small drop in covering power value when the acid value is 200, but such values are improved relative to the use of masterbatch polymers with Acid Value below 30.

The invention has been described in detail with particular reference to certain preferred embodiments thereof, but it will be understood that variations and modifications can be effected within the spirit and scope of the invention.

The invention claimed is:

1. A process for preparation of toner particles comprising carbon black and polymeric binder, comprising:

preparing a masterbatch comprising carbon black particles and a first addition polymer comprising carboxylic acid groups along the polymer backbone and having an Acid Value of from 50-200, where the first addition polymer is present at a weight ratio of greater than 1:2 relative to the amount of carbon;

dissolving a thermoplastic second polymer binder in an organic solvent;

adding the masterbatch to the solution of second polymer binder to form an organic phase, wherein the first addition polymer is present at a lower weight percent than the second polymer;

dispersing the organic phase in an aqueous phase comprising a particulate stabilizer to form a dispersion; and removing the solvent from the organic phase to form toner particles comprising the first addition polymer, the second polymer binder, and carbon black.

2. A process according to claim 1, wherein the first addition polymer is present at a weight ratio of up to 4:1 relative to the amount of carbon.

3. A process according to claim 1, wherein the first addition polymer is present at a weight ratio of from 1:1 to 3:1 relative to the amount of carbon.

4. A process according to claim 1, wherein the first addition polymer is present at a weight ratio of from 1:1 to 2:1 relative to the amount of carbon.

5. A process according to claim 1, wherein the first addition polymer has a weight average molecular weight Mw of from 3,000-20,000.

6. A process according to claim 1, wherein the first addition polymer has a weight average molecular weight Mw of from 4,000-10,000.

7. A process according to claim 1, wherein the formed toner particles have a mean volume-average diameter of less than about 8 μm, and include 1 wt. % to 20 wt. % carbon pigment.

8. A process according to claim 1, wherein the formed toner particles have a mean volume-average diameter of from 3 μm to 7 μm, and include 3 wt. % to 10 wt. % of carbon pigment.

9. A process according to claim 1, wherein the second polymer binder comprises a polyester.

10. A process for preparation of toner particles comprising carbon black and polymeric binder, comprising:

preparing a masterbatch comprising carbon black particles and a first addition polymer comprising carboxylic acid groups along the polymer backbone and having an Acid Value of from 50-150, where the first addition polymer is present at a weight ratio of greater than 1:2 relative to the amount of carbon;

dissolving a thermoplastic second polymer binder in an organic solvent;

adding the masterbatch to the solution of second polymer binder to form an organic phase, wherein the first addition polymer is present at a lower weight percent than the second polymer;

dispersing the organic phase in an aqueous phase comprising a particulate stabilizer to form a dispersion; and removing the solvent from the organic phase to form toner particles comprising the first addition polymer, the second polymer binder, and carbon black.

* * * * *